US008516639B2

(12) United States Patent
Mobley et al.

(10) Patent No.: US 8,516,639 B2
(45) Date of Patent: Aug. 27, 2013

(54) SURGICAL POSITIONING PILLOW

(76) Inventors: Ed Mobley, Knoxville, TN (US); Eric Cox, Knoxville, TN (US); Tracy Thompson, Knoxville, TN (US)

( * ) Notice: Subject to any disclaimer, the term of this patent is extended or adjusted under 35 U.S.C. 154(b) by 0 days.

(21) Appl. No.: 12/965,076

(22) Filed: Dec. 10, 2010

(65) Prior Publication Data

US 2012/0144591 A1 Jun. 14, 2012

(51) Int. Cl.
*A61G 7/07* (2006.01)

(52) U.S. Cl.
USPC ..... 5/640; 5/636

(58) Field of Classification Search
USPC ..... 5/630, 632, 634, 636, 638, 640, 652, 5/655.9
See application file for complete search history.

(56) References Cited

U.S. PATENT DOCUMENTS

| | | | | |
|---|---|---|---|---|
| 2,700,779 | A | 2/1955 | Tolkowsky | |
| 2,782,427 | A | 2/1957 | Ericson | |
| 4,074,376 | A * | 2/1978 | Bond | 5/632 |
| 5,097,551 | A | 3/1992 | Smith | |
| 5,479,667 | A | 1/1996 | Nelson et al. | |
| 5,644,809 | A | 7/1997 | Olson | |
| 5,906,205 | A | 5/1999 | Hiebert | |
| 6,065,166 | A | 5/2000 | Sharrock et al. | |
| 6,345,401 | B1 * | 2/2002 | Frydman | 5/636 |
| 6,629,324 | B1 * | 10/2003 | Shapiro | 5/636 |
| 7,441,293 | B1 | 10/2008 | Singer et al. | |
| 7,634,828 | B2 | 12/2009 | Elhabashy | |
| 2005/0198738 | A1 * | 9/2005 | Hedges | 5/636 |
| 2008/0092296 | A1 * | 4/2008 | Guez | 5/636 |
| 2008/0134437 | A1 | 6/2008 | Small | |

* cited by examiner

*Primary Examiner* — Michael Trettel
*Assistant Examiner* — Myles Throop
(74) *Attorney, Agent, or Firm* — Pitts & Lake, P.C.

(57) ABSTRACT

A surgical support system including a positioning pillow to support a patient in a lateral position on an operating table. The positioning pillow includes a head supporting surface having an opening to accommodate an ear of the laterally positioned patient and a channel intersecting the opening to accommodate an eye of the laterally positioned patient, a shoulder supporting surface disposed adjacent to the head supporting surface and oriented substantially perpendicular to the head supporting surface to accommodate a shoulder of the laterally positioned patient, and a bottom surface disposed opposite to the head supporting surface and adjacent to the shoulder supporting surface, the head supporting surface being angled relative to the bottom surface to align the patient's thoracic and cervical spine at a predetermined angle with respect to the operating table when the patient's head is positioned on the head supporting surface in the lateral position.

6 Claims, 3 Drawing Sheets

SURGICAL POSITIONING PILLOW

BACKGROUND

1. Field of Invention

The present inventive concept relates generally to surgical support devices, and more particularly, to a surgical positioning pillow to support a patient in a lateral position on an operating table.

2. Description of the Related Art

The controlled positioning of patients is of significant importance in many surgical procedures. Pillows contoured with special shapes have been developed to support a patient in one or more positions on an operating table during surgery. Some surgeries by necessity require the patient to be placed in a lateral or semi-lateral position wherein the patient is lying on his or her side.

For example, when a patient is maintained in a lateral or semi-lateral position during surgery, both of the patient's arms extend to the same side of the operating table, with one arm vertically positioned above the other arm. In the lateral position, one of the patient's shoulders is substantially raised above the level of the other which, without external means of support, generally results in the associated arm extending downwardly across the patient's chest. This position can result in the pinching of the brachial plexus nerve located in the underarm area at the juncture of the arm to the body. Prolonged pinching of the brachial plexus nerve can cause temporary or, in some cases, permanent damage to the nerve with the result being a loss of feeling and function to the patient's arm.

Attempts have been made to effect and maintain side and semi-side positions for patients on operating tables and beds including the use of a pillow, towel, blanket, cushion, bolster, or other device to prop up the patient's head, chest, or back. However, none of these devices have been entirely satisfactory, or even capable, of supporting the patient's head and body to prevent pressure points on the shoulders and arms to protect the patient's brachial plexus when placing the patient in a lateral position, nor have they been entirely satisfactory in providing equal distribution of pressure points including neutral spine positioning, while also accommodating a patient's ears and facilitating monitoring of a patient's eyes throughout a surgical procedure.

SUMMARY

The present general inventive concept provides a surgical positioning pillow capable of supporting a patient's head and body during surgery to protect the patient's brachial plexus when the patient is lying in a lateral position. The pillow can provide for equal distribution of the pressure of the weight of the head when the patient is positioned laterally and can maintain neutral spine positioning. The pillow is also designed to accommodate a patient's ears and eyes to prevent pressure injuries, and to facilitate monitoring of a patient's eyes during a surgical procedure.

Additional features and embodiments of the present general inventive concept will be set forth in part in the description which follows and, in part, will be obvious from the description, or may be learned by practice of the general inventive concept.

Example embodiments of the present general inventive concept can be achieved by providing a positioning pillow to support a patient in a lateral position on an operating table, including a head supporting surface having an opening to accommodate an ear of the laterally positioned patient and a channel intersecting the opening to accommodate an eye of the laterally positioned patient and to provide an uninterrupted line of sight from an outside of the head supporting surface to the eye, a shoulder supporting surface disposed adjacent to the head supporting surface and oriented substantially perpendicular to the head supporting surface to accommodate a shoulder of the laterally positioned patient, and a bottom surface disposed opposite to the head supporting surface and adjacent to the shoulder supporting surface, the head supporting surface being angled relative to the bottom surface to align the patient's thoracic and cervical spine at a predetermined angle with respect to the operating table when the patient's head is positioned on the head supporting surface in the lateral position.

The surgical positioning pillow can further include a back surface disposed opposite the shoulder supporting surface and substantially parallel to the shoulder supporting surface such that the height of the back surface is greater than the height of the shoulder supporting surface relative to the bottom surface.

The bottom surface can include at least one removable layer to adjust the height of the head supporting surface relative to the bottom surface, and the predetermined angle can be about 17 degrees.

Example embodiments of the present general inventive concept can also be achieved by providing a surgical support system including an axillary roll having a diameter to accommodate an axillary region of the patient to support the patient's thoracic spine at a predetermined angle relative to the operating table, and a positioning pillow to support the patient's head when the patient is lying in the lateral position on the operating table. The positioning pillow can include a head supporting surface having an opening to accommodate an ear of the laterally positioned patient and a channel intersecting the opening to accommodate an eye of the laterally positioned patient and to provide an uninterrupted line of sight from an outside of the head supporting surface to the eye, a shoulder supporting surface disposed adjacent to the head supporting surface and oriented substantially perpendicular to the head supporting surface to accommodate a shoulder of the laterally positioned patient, and a bottom surface disposed opposite to the head supporting surface and adjacent to the shoulder supporting surface, the head supporting surface being angled relative to the bottom surface to align the patient's thoracic and cervical spine at the predetermined angle with respect to the operating table when the patient's head is positioned on the head supporting surface in the lateral position.

BRIEF DESCRIPTION OF THE DRAWINGS

The above-mentioned features of the present general inventive concept will become more clearly understood from the following detailed description read together with the drawings in which.

DETAILED DESCRIPTION

Figure 1:
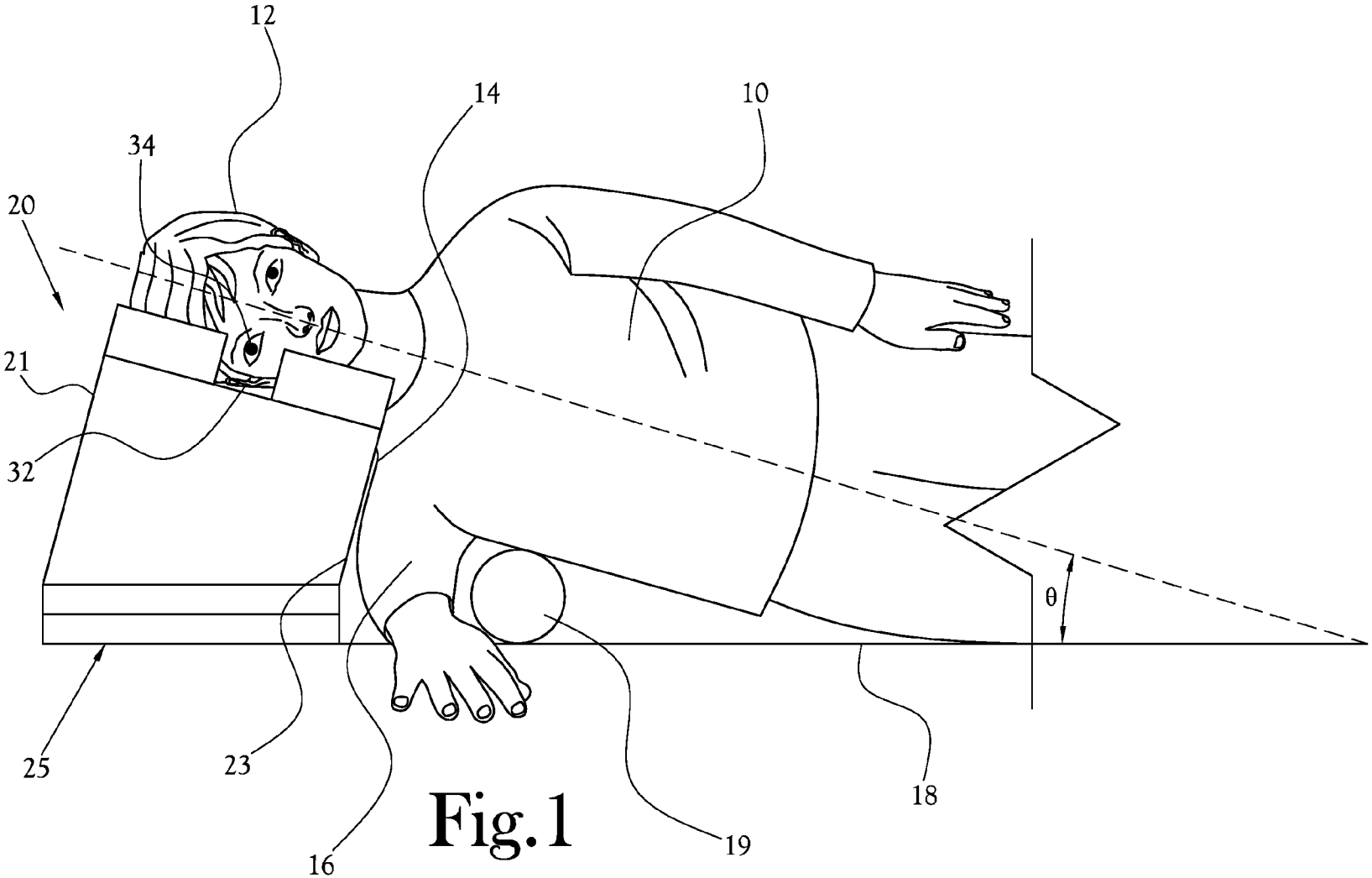
FIG. 1 is a perspective view of a patient lying on an operating table in a lateral position with the head, shoulder, and arm of the patient accommodated and supported by a surgical positioning pillow according to an example embodiment of the present general inventive concept.

Reference will now be made to various embodiments of the present general inventive concept, examples of which are illustrated in the accompanying drawings, wherein like reference numerals refer to like elements throughout. The following description of the various embodiments is merely exemplary in nature and is in no way intended to limit the present general inventive concept, its application, or uses. The example embodiments are merely described below in order to explain the present general inventive concept by referring to the figures.

The following detailed description and claims may recite various descriptive terms such as horizontal, vertical, top, bottom, upward, downward, left, right, etc., when referring to the exemplary figures, but the present general inventive concept is not limited to any such terms or physical orientations. Such terms are used for convenience of description only, and could be reversed, modified, or interchanged without departing from the broader scope and spirit of the present general inventive concept.

The present general inventive concept provides a lateral positioning system configured in shape and size to support a patient's head, shoulder, and spine at a predetermined angle during surgery to protect, among other things, the patient's brachial plexus. The system includes a positioning pillow to provide for equal distribution of the pressure of the weight of the head when the patient is positioned laterally and can maintain neutral spine positioning. The pillow is designed to accommodate a patient's ears and eyes to prevent pressure injuries, and to facilitate monitoring of a patient's eyes during a surgical procedure.

FIG. 1 is a perspective view of a patient lying on an operating table in a lateral position with the head, shoulder, and arm positioned and supported by a lateral positioning pillow according to an example embodiment of the present general inventive concept.

Referring to FIG. 1, the surgical support system includes a lateral positioning pillow 20 to support the head 12, shoulder 14, and arm 16 of a surgical patient 10 lying in a lateral position on an operating table 18. The system can also include an axillary roll 19 configured in shape and size to be placed under the patient in the axillary region.

Figure 2:
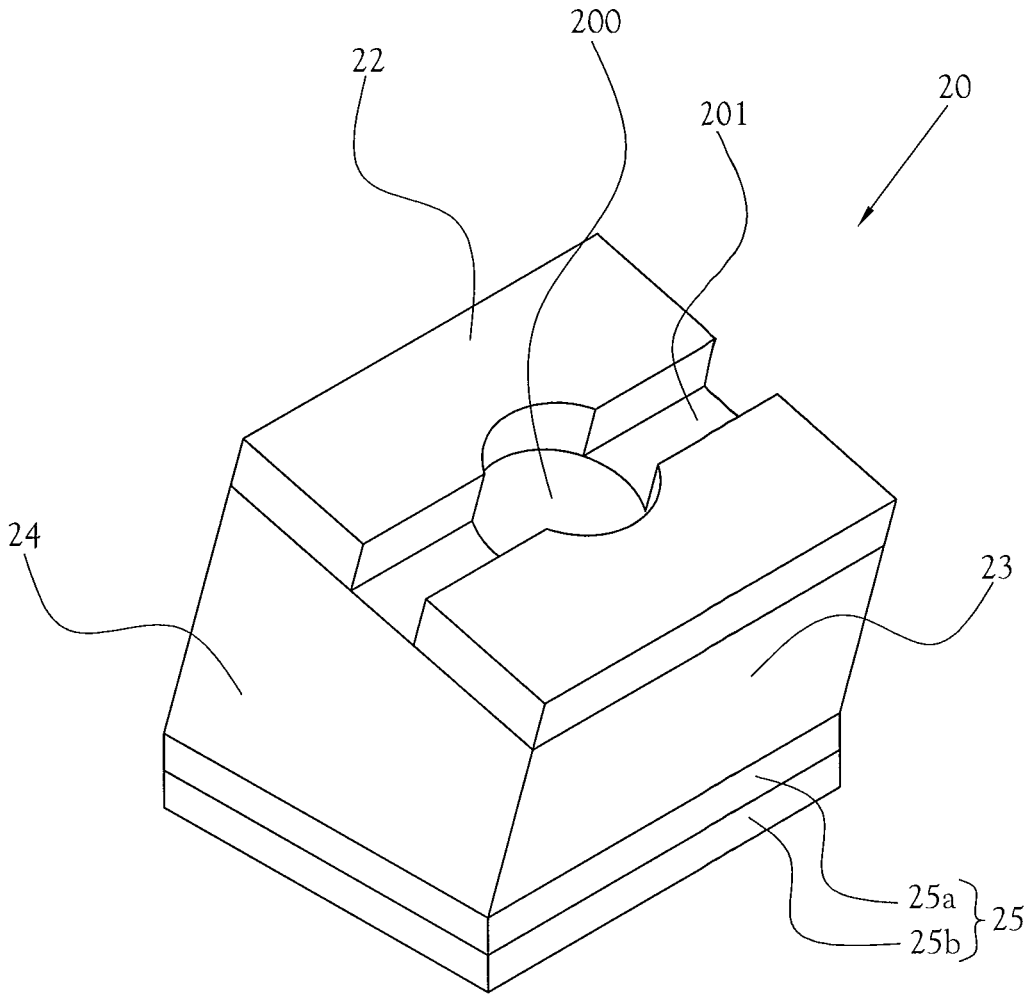
FIG. 2 is a perspective view of a surgical positioning pillow configured in accordance with an example embodiment of the present general inventive concept.

Referring to FIGS. 1 and 2, the head supporting top surface 22 of the pillow 20 is angled downwardly with respect to the bottom surface 25 at a predetermined angle θ relative to the horizontal plane of the operating table 18.

Referring to FIG. 1, the predetermined angle θ can be approximately 17 degrees, but can be less or greater than 17 degrees, depending on the size and shape of a particular patient. The angled head supporting surface 22 can tilt the patients spine at a predetermined angle relative to the operating table 18 to maintain proper alignment of the thoracic and cervical spine for most patients.

When positioning the patient in the lateral position, it is important to protect the patient's brachial plexus. In general, there are two main areas of interest. The first area is generally defined from the insertion of the nerve roots at the level of the cervical vertebra to the clavicle. This area can be protected by maintaining a neutral position of the cervical spine, thus limiting tilting of the head from side to side. The second area is where the cords of the brachial plexus pass under the clavicle, through the axilla, to the distal branches in the arm. To help maintain proper positioning at the predetermined angle θ, it is possible to incorporate an axillary roll 19 device to be placed in the axilla region, as illustrated in FIG. 1, in combination with the positioning pillow 20. In one embodiment, the axillary roll 19 is dimensioned to be approximately 3-4 inches in diameter, such that when the axillary roll 19 is placed under the patient in the axillary region, stretching of the brachial plexus distal to the clavicle can be prevented.

Referring to FIG. 1, the axillary roll 19 can accommodate the natural curvature of the thoracic spine to tilt the spine at the predetermined angle θ, to maintain proper alignment of the thoracic and cervical spine.

The support system of the present general inventive concept can maintain alignment of the thoracic and cervical spine when the patient is lying in the lateral position, allowing the cervical aspect of the brachial plexus to be free from stretch. However, it is noted that the present general inventive concept is not limited to any particular diameter of axilla roll 19, angle θ, height of the pillow 20, etc. To the contrary, the specific dimensions of the system may vary to accommodate different applications and/or sizes and shapes of patients. For example, the precise dimensions, depth, and areas of the various surfaces can be various shapes and sizes without departing from the scope and spirit of the present general inventive concept, and the predetermined angle θ is not limited to exactly 17 degrees.

Referring to FIGS. 1 and 2, the shoulder supporting front surface 23 of the exemplary lateral positioning pillow 20 is angled downwardly and inwardly with respect to the bottom surface 25 such that the shoulder supporting front surface 23 and bottom surface 25 form a cut-out portion oriented substantially perpendicular to the top surface 22 to conform to the shape of the shoulder 14 when the patient is lying in the lateral position with the arm 16 extended. The front shoulder supporting surface 23 may also take the form of a curvature region dimensioned in shape and size to conform to the shape of the patient's shoulder when the arm 16 is extended. The angled shoulder supporting front surface 23 provides clearance and support for the patient's shoulder when the shoulder of a relaxed, anesthetized patient is displaced cephalad (i.e., towards the head).

As illustrated in FIGS. 1 and 2, the shoulder supporting front surface 23 can be angled perpendicular to the adjacent head supporting surface 22 toward the adjacent bottom surface 25. The junction of the front surface 23 and the bottom surface 25 can form an obtuse angle between the surfaces, as illustrated in FIG. 1. In this way, the front supporting surface 23 accommodates and supports the patient's displaced shoulder as the patient is lying on his side in the lateral position, as the angled shoulder supporting front surface 23 better conforms to the shape of the patient's shoulder in the displaced cephalad position. However, the present general inventive concept is not limited to any particular angle of the shoulder supporting front surface, and the angle may be varied to accommodate different shapes and/or sizes of patients shoulders. In addition, it is possible to configure the front supporting surface 23 as a curved surface to accommodate and support the patient's shoulder region. It is also possible to position the pillow 20 and/or axillary roll 19 further away or closer to each other, as the case may be, to properly align the thoracic and cervical spine of large and small patients, respectively.

Referring to FIGS. 1 and 2, the head support surface 22 includes an opening 200 to accommodate an ear 32 of the laterally positioned patient. This helps prevent pressure injuries to the ear 32. The opening 200 allows the ear 32 to remain in its natural configuration and not become folded upon itself.

The head support surface 22 also includes a channel region 201 intersecting the opening to accommodate an eye 34 of the laterally positioned patient. The channel 201 helps allow the eye 34 to be free of pressure, while at the same time providing an uninterrupted line of sight from an outside of the head support surface to the eye, allowing the anesthesia provider or other personnel to monitor the patient's eye 34 throughout a particular surgical procedure. Generally speaking, surgery can be a dynamic event where the operating table or bed is periodically turned, which can result in the inadvertent changing of the patient's head. In one embodiment, as illustrated in FIG. 2, the channel 201 is provided throughout an entire length of the head supporting surface 22, with results being that the positioning pillow 20 can be universal for both right and left lateral positions.

In one embodiment, the top head supporting surface 22 supporting the patient's head can be sloped with respect to the horizontal plane of the operating table 18 to maintain proper alignment of the patient's spine, and the top surface 22 can further include an opening 200 to accommodate the patient's ear 32 and/or a channel 201 to accommodate the patient's eye 34 to reduce the likelihood of pressure being applied to the eye and ear during an operation.

Referring to FIGS. 1 and 2, the shoulder supporting surface 23 is disposed adjacent to the head supporting surface 22 and oriented substantially perpendicular thereto to accommodate a shoulder region 14 of the laterally positioned patient. The bottom surface 25 of the positioning pillow 20 is disposed opposite to the head supporting surface 22 and adjacent to the shoulder supporting surface 23, and the bottom surface 25 is angled relative to the head supporting surface 22 to tilt the patient at a predetermined angle to align the patient's thoracic and cervical spine at a predetermined angle θ with respect to the operating table when the patient's head is positioned on the positioning pillow 20 in the lateral position, thus allowing the pillow 20 to engage the patient's head 12 more effectively.

Figure 3A:
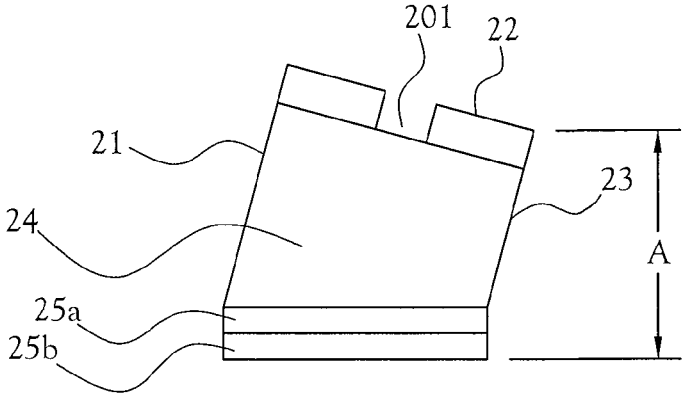
FIGS. 3*a* to 3*c* are side views illustrating removable bottom layers to adjust the height of the surgical positioning pillow in accordance with example embodiments of the present general inventive concept.
Figure 3B:
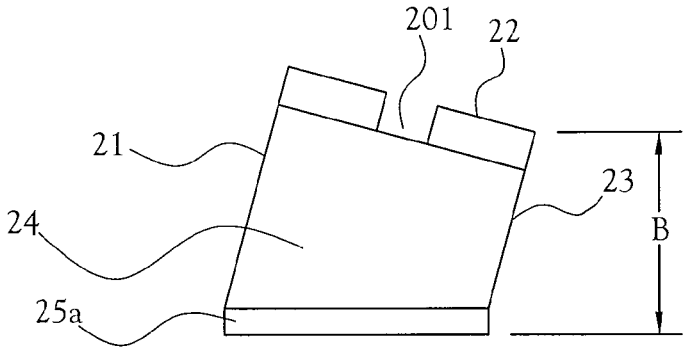
Figure 3C:
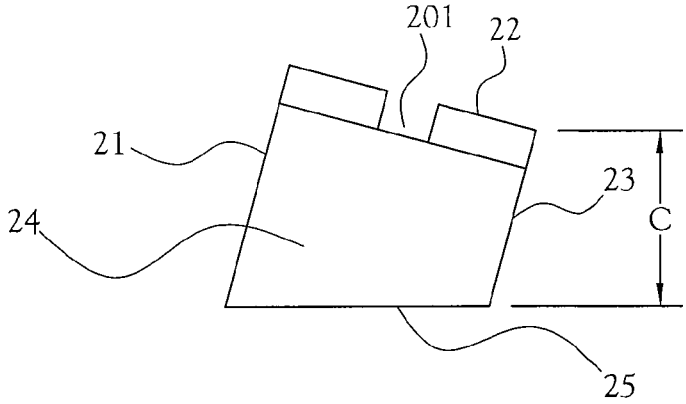

Referring to FIGS. 3*a* to 3*c*, the surgical positioning pillow 20 can further include a back surface 21 disposed opposite the shoulder supporting surface 23 and substantially parallel thereto such that the height of the back surface 21 is greater than the height of the shoulder supporting surface 23 relative to the bottom surface 25.

The vertical height of the front of the pillow is the distance from the bed to the level of the mandible, as generally represented by reference characters A,B,C of FIGS. 3*a*, 3*b*, 3*c*, respectively. The vertical height of the back of the pillow reflects the angle of the spine in a neutral position. As illustrated in FIGS. 3*a* to 3*c*, the pillow's vertical height A,B,C is adjustable to accommodate patients of different sizes by selectively installing or removing one or more removable layers 25*a*, 25*b*.

Referring to FIGS. 3A to 3C, the bottom surface 25 of the supporting pillow 20 can include one or more removable layers 25*a*, 25*b*. These layers 25*a*, 25*b* can be selectively removed, depending on the size or shape of the patient 10, to selectively raise or lower the overall height A, B, or C, of the pillow 20 to adjust the height of the pillow 20 relative to the operating table 18. This enables the system to adjust the resting height of the patient's head relative to the operating table to maintain proper alignment of the patient's spine when the patient's head is resting on the head supporting surface 22 of the pillow 20.

The present general inventive concept can inhibit the patient's spine from being aligned parallel to the bed to reduce the pressure on the mandible relative to the superior aspect of the head. Having the pillowed angled also allows for equal distribution of the pressure of the weight of the head when positioned laterally.

While the present general inventive concept has been illustrated by description of example embodiments and while the illustrative embodiments have been described by referring to the drawings, it is not the intention of the applicant to restrict or in any way limit the scope of the appended claims to the illustrative examples. Additional advantages and modifications of the present general inventive concept will readily appear to those skilled in the art. The present general inventive concept in its broader aspects is therefore not limited to the specific details, representative apparatus and methods, and illustrative examples illustrated and described. Accordingly, departures may be made from such details without departing from the spirit or scope of applicant's general inventive concept.

What is claimed is:

1. A surgical positioning pillow to support a patient in a lateral position on an operating table, comprising:

a head supporting surface having an opening to accommodate an ear of the laterally positioned patient, the head supporting surface including a channel extending from opposing sides of the head supporting surface and intersecting the opening to accommodate an eye of the laterally positioned patient therein, the opposing sides defining a width of the pillow and the channel having a constant depth relative to the head supporting surface throughout the width of the pillow to provide an uninterrupted line of sight within the channel from each opposing side of the head supporting surface to the opening;

a shoulder supporting surface disposed between the opposing sides of the head supporting surface and substantially perpendicular to the head supporting surface to accommodate a shoulder of the laterally positioned patient;

a bottom surface disposed opposite to the head supporting surface and adjacent to the shoulder supporting surface; and a rear surface disposed opposite to the shoulder supporting surface and extending substantially parallel to the shoulder supporting surface and adjacent to the opposing sides of the head supporting surface and the bottom surface, the rear surface having a height greater than a height of the shoulder supporting surface relative to the bottom surface.

2. The surgical positioning pillow of claim 1, wherein the bottom surface includes at least one removable layer to adjust the height of the head supporting surface relative to the bottom surface.

3. The surgical positioning pillow of claim 1, wherein the head supporting surface is angled relative to the bottom surface at an angle of about 17 degrees.

4. A surgical support system to support a patient in a lateral position on an operating table, comprising:

an axillary roll having a diameter to accommodate an axillary region of the patient to support the patient's thoracic spine at a predetermined angle relative to the operating table; and a positioning pillow to support the patient's head when the patient is lying in the lateral position on the operating table, the positioning pillow comprising:

a head supporting surface having an opening to accommodate an ear of the laterally positioned patient, the head supporting surface including a channel extending from opposing sides of the head supporting surface and intersecting the opening to accommodate an eye of the laterally positioned patient therein, the opposing sides defining a width of the pillow and the channel having a constant depth relative to the head supporting surface throughout the width of the pillow to provide an uninterrupted line of sight within the channel from each opposing side of the head supporting surface to the opening;

a shoulder supporting surface disposed between the opposing sides of the head supporting surface and substantially perpendicular to the head supporting surface to accommodate a shoulder of the laterally positioned patient;

a bottom surface disposed opposite to the head supporting surface and adjacent to the shoulder supporting surface; and a rear surface disposed opposite to the shoulder supporting surface and extending substantially parallel to the shoulder supporting surface and adjacent to the opposing sides of the head supporting surface and the bottom surface, the rear surface having a height greater than a height of the shoulder supporting surface relative to the bottom surface.

5. The surgical support system of claim 4, wherein the bottom surface of the positioning pillow includes at least one removable layer to adjust the height of the head supporting surface relative to the bottom surface.

6. The surgical support system of claim 4, wherein the head supporting surface is angled relative to the bottom surface at an angle of about 17 degrees.

* * * * *